US012752154B2

(12) United States Patent
Peled

(10) Patent No.: US 12,752,154 B2
(45) Date of Patent: Oct. 6, 2026

(54) FINGER TRAINING DEVICE

(71) Applicant: Efrat Peled, Magshimim (IL)

(72) Inventor: Efrat Peled, Magshimim (IL)

( * ) Notice: Subject to any disclaimer, the term of this patent is extended or adjusted under 35 U.S.C. 154(b) by 29 days.

(21) Appl. No.: 19/023,588

(22) Filed: Jan. 16, 2025

(65) Prior Publication Data

US 2026/0199731 A1 Jul. 16, 2026

(51) Int. Cl.

| | |
|---|---|
| ***A63B 23/16*** | (2006.01) |
| ***A63B 21/00*** | (2006.01) |
| ***A63B 21/02*** | (2006.01) |
| ***A63B 21/04*** | (2006.01) |
| ***A63B 24/00*** | (2006.01) |

(52) U.S. Cl.

CPC ..... *A63B 23/16* (2013.01); *A63B 21/023* (2013.01); *A63B 21/0428* (2013.01); *A63B 21/4035* (2015.10); *A63B 24/0059* (2013.01); *A63B 2024/0068* (2013.01); *A63B 2220/58* (2013.01); *A63B 2220/833* (2013.01)

(58) Field of Classification Search

CPC ... A63B 23/16; A63B 21/023; A63B 21/0428; A63B 21/4035; A63B 24/0059; A63B 2024/0068; A63B 2220/58; A63B 2220/833

See application file for complete search history.

(56) References Cited

U.S. PATENT DOCUMENTS

| | | | | |
|---|---|---|---|---|
| 9,005,084 | B2 | 4/2015 | Silagy et al. | |
| 9,700,758 | B1 | 7/2017 | Goldberg | |
| 2009/0318269 | A1* | 12/2009 | D'Addario | A63B 21/023 482/49 |
| 2021/0338114 | A1* | 11/2021 | Teremetz | A61B 5/6825 |
| 2022/0160293 | A1* | 5/2022 | Moreau | A61B 5/225 |
| 2023/0041782 | A1* | 2/2023 | Nishioka | A61B 5/743 |

FOREIGN PATENT DOCUMENTS

| | | | | |
|---|---|---|---|---|
| CN | 212548168 | U | 2/2021 | |
| CN | 218529699 | U | 2/2023 | |
| CN | 117860522 | A | 4/2024 | |
| KR | 101500483 | B1 | 3/2015 | |
| WO | WO-2019122885 | A1 * | 6/2019 | A61B 5/1125 |
| WO | WO-2023067553 | A1 * | 4/2023 | A61B 5/1114 |

OTHER PUBLICATIONS

Ahmed, Wasiq, et al. "An automated game-based variable-stiffness exoskeleton for hand rehabilitation." International Journal of Mechanical Engineering and Robotics Research 9.4 (2020): 603-611.—9 Pages.

* cited by examiner

*Primary Examiner* — Andrew M Kobylarz
(74) *Attorney, Agent, or Firm* — The Roy Gross Law Firm, LLC; Roy D. Gross

(57) ABSTRACT

A finger training device comprising: a body; and a plurality of finger-engaging members connected to the body, wherein at least one of the finger-engaging members is pressable against with resisting force along a path comprising a curved or piecewise linear path, wherein the curved or piecewise linear path comprises a vertical component and a horizontal component is traversed along a vertical portion followed by a horizontal portion.

16 Claims, 9 Drawing Sheets

FINGER TRAINING DEVICE

FIELD OF THE INVENTION

The invention relates to the field of training and exercising a user's fingers, for purposes such as rehabilitation, improving one's abilities, strengthening musical instrument playing, or others.

BACKGROUND

Finger exercising devices are useful in a variety of applications. Some applications are related to overcoming physiological difficulty or dysfunction and rehabilitation of the hand and fingers, due to age or medical condition such as arthritis, a stroke, Parkinson's disease, or the like. Other applications relate to rehabilitation following an injury, a surgery or another traumatic event. Further applications relate to strengthening and improving control of the fingers for various purposes such as playing musical instruments, certain sports, as part of whole body strengthening, or the like.

Some currently available devices are intended for developing hand or finger force and are very simple. Such devices include various types of finger and hand exercise devices, such as a V-spring having handles on either leg which are held in the hand and repeatedly squeezed together. Another type of devices features two parallel handles which are urged apart by an arrangement of springs or elastomeric bands which are grasped between the thumb and forefingers and squeezed together. Yet another style of hand exerciser features individual spring-activated plungers and an opposing spring activated palm rest. Still others utilize a wristband or glove arrangement having an array of elastomeric tethers running from the fingers to an anchor point. Various other shapes and styles of squeezable foam rubber devices have also been used.

Other devices are more specific for developing finger dexterity and strength but are generally expensive, cumbersome and large, e.g., need a cart to be moved around, and can therefore be used mainly by physiotherapists or other caregivers at their clinics, at hospitals, or the like, therefore the possible usage is for limited periods of time, and mainly for therapy needs.

SUMMARY

The following embodiments and aspects thereof are described and illustrated in conjunction with systems, tools and methods which are meant to be exemplary and illustrative, not limiting in scope.

One exemplary embodiment of the disclosed subject matter is a finger training device comprising: a body; and a plurality of finger-engaging members connected to the body, wherein at least one of the finger-engaging members is pressable against with resisting force along a path comprising a curved or piecewise linear path, wherein the curved or piecewise linear path comprises a vertical component and a horizontal component. Within the finger training device, the piecewise linear path is optionally traversed along a vertical portion followed by a horizontal portion. Within the finger training device, at least one of the finger-engaging members optionally comprises: a slider comprising a first part and a second part; a finger cup for receiving at least a distal part of a finger of a user; and an insert adapted to receive a first portion of the finger cup, wherein the first part of the slider is adapted to receive a portion of the insert, the portion of the insert varying in accordance with a first press applied to the insert by the finger when inserted into the finger cup, and wherein the body is adapted to receive a portion of the second part of the slider, the second portion varying in accordance with a second press applied to the slider by the insert. Within the finger training device, the first part of the slider is optionally vertical and the second part of the slider is optionally horizontal, when the finger training device is in use. Within the finger training device, the first press is optionally applied by the user pressing down a finger inserted into the finger cup, and the second press is optionally applied by the user pulling the fingertip towards the palm of the user. Within the finger training device, in order for the slider to be movable into the body, the finger cup has to be lowered first. Within the finger training device, the first part of the slider optionally comprises a first spring and the second part of the slider optionally comprises a second spring, and wherein the first press is applied against the first spring, and the second press is applied against the second spring. Within the finger training device, a first part of the finger cup that is closer to a palm of the user optionally has a higher rim than a second part of the finger cup that is farther from the palm of the user. The finger training device optionally further comprises: a sensor system comprising: at least one sensing device coupled to each of at least one finger-engaging member of the plurality of finger-engaging members, for sensing movement of the at least one finger-engaging member; a controller for communicating with the at least one sensor; and a communication device for receiving indications to the movement from the controller and transmitting the indications to a computerized platform. Within the finger training device, the at least one sensing device optionally comprises: a magnet located at or near a first end of the second spring; and a magnetic sensor located at or near a second end of the second spring, for outputting an indication of a distance of the magnetic sensor from the magnet. Within the finger training device, the magnetic sensor is optionally a Hall effect sensor. Within the finger training device, the computerized platform is optionally adapted to execute an application, the application configured to: present to a user a challenge, wherein an expected reaction to the challenge comprises activating at least one of the plurality of finger-engaging members; receive from the communication device information comprising an indication to which finger-engaging member from the plurality of finger-engaging members has been activated and parameters of a movement of the finger; determine based on the information a positive or negative reward to be provided to the user; and provide the positive or negative reward to the user. Within the finger training device, the application is further configured to: generate a report; and provide the report to the user or to another person.

Another exemplary embodiment of the disclosed subject matter is a computer program product comprising non-transitory computer program instructions configured, when executed by a processor, to cause the processor to perform: presenting to a user a challenge, wherein an expected reaction to the challenge comprises activating at least one of a plurality of finger-engaging members of a finger training device, the finger training device operatively connected to a computing device executing the computer program instructions; receiving from the communication device information comprising an indication to which finger-engaging member from the plurality of finger-engaging members has been activated and parameters of a movement of a finger; and determining based on the information a positive or negative reward to be provided to the user; and providing the positive or negative reward to the user. Within the computer program product, the computer program instructions are further configured to: generate a report; and provide the report to the user or to another person.

In addition to the exemplary aspects and embodiments described above, further aspects and embodiments will become apparent by reference to the figures and by study of the following detailed description.

BRIEF DESCRIPTION OF THE DRAWINGS

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

Figure 1A:
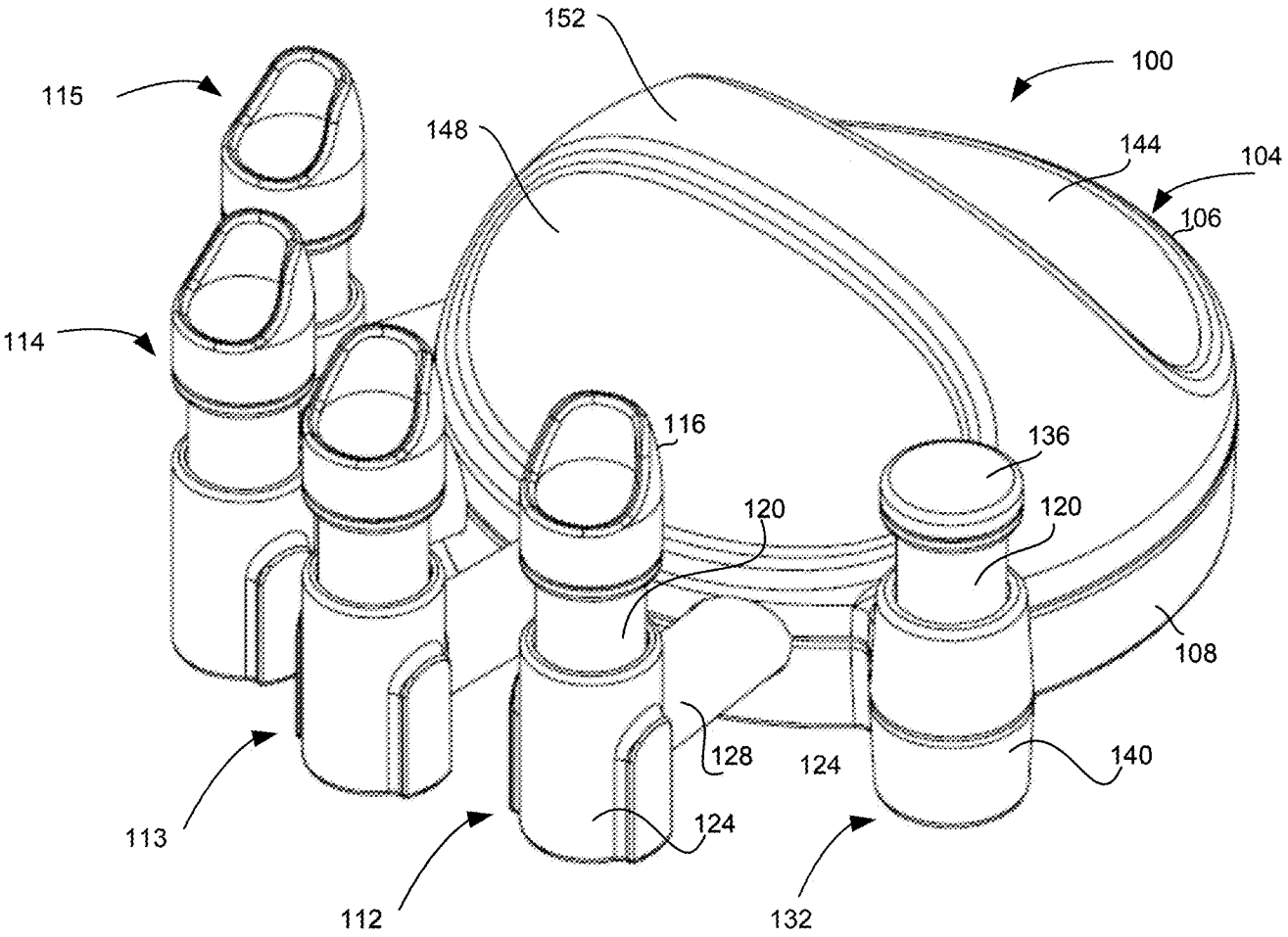
FIGS. 1A, 1B and 1C show an isometric view, a top view, and a front view, respectively, of a device of a device for exercising a user's fingers, in accordance with some exemplary embodiments of the disclosure.

The description below describes a device for training a user's fingers. When the device is placed on a plane and is used by the user with the user's head up, the term "down" should be construed as "substantially vertically, towards the plane from above the plane". The word "forward" should be construed as "towards the user's body or torso, e.g., in the direction from distal to proximal".

In the description below the terms "question", "multi-choice question", "challenge", "mental challenge" or others are used interchangeably and are to be widely construed to cover any type of question the answer for which comprises one or more of four possibilities.

One technical problem of the disclosure relates to a need for a device or system for exercising a user's fingers. Such exercising may be required for improving a subject's condition that deteriorated due to age, disease, injury, operation, or the like. Exercising may also be required for healthy subjects playing musical instruments, exercising certain sport activities, people who need high dexterity such as surgeons, gamers, or any person wishing to improve the dexterity, flexibility and force of one's fingers.

Another technical problem of the disclosure is a need for such device to be adequate for home use, such that a user can exercise as often as she likes. Therefore, the device needs to be easily portable, small in size, and inexpensive.

Yet another technical problem of the disclosure is a need to quantify and report online and/or offline the performance of the user, whether for the user's own review and/or to be transmitted to a caregiver, a teacher or another person. Such reports may be helpful in evaluating the user's state and planning a continuation exercising program.

Yet another technical problem of the disclosure is a need to make exercising with the device appealing to a user. A device that merely enables tedious and boring exercising is likely to be abandoned quickly, thus undermining its intended purpose. Therefore the device needs to offer some mental challenge or fun, in addition to the physical exercising.

One technical solution of the disclosure provides a device for exercising or training a user's fingers. It is appreciated that such device may actually comprise two devices, one for the left hand and the other for the right hand, wherein the devices may or may not be completely symmetrical with each other. For simplicity, and unless noted otherwise, each one-hand device is hereby referred as a "device", and the disclosure is equally applicable to the other-hand device, with the required modifications.

In some exemplary embodiments, the device comprises a body and five finger-engaging members coupled to the body, wherein at least one of the finger-engaging members is pressable against with resisting force, along a path comprising a vertical component and a horizontal component. The path may be curved, straight, or piecewise linear path. The curved path may be an arc-like two-dimensional path wherein some parts thereof may comprise combined horizontal component and a vertical component, wherein the piecewise linear path may be traversed along a vertical portion followed by a horizontal portion, or vice versa.

Thus, a user may place the palm of the user's hand on the external shell of the body, and each finger in a respective finger-engaging member. For all fingers but the thumb, the user can then press down in a vertical direction the finger-engaging member, and can then pull the finger-engaging member in a horizontal direction towards the palm, such that a part of the finger-engaging member is inserted into the body. It is appreciated that pulling the finger-engaging member in the horizontal direction may be performed without releasing the press in the vertical direction. This arrangement provides for a two-dimensional gesture of the respective finger, such as gripping while pressing down. Strengthening the user's ability to perform this gesture is of particular importance in a variety of uses, for example when playing a musical instrument where it is needed to keep the player's fingers convex, such as a piano, for climbers, masseuses, or the like. In some embodiments, only a part of the motion is enabled for the thumb, e.g., only pressing down the finger-engaging member.

The device may be about the size of a hand, portable and at an affordable price. Therefore, it is adapted for home use, such that a user can buy, borrow or rent the device and practice on her free time.

It is appreciated that devices may be offered of various sizes, for various types of users, such as small children, older children, small adult, large adult, or the like.

In some embodiments, the finger-engaging member for each of the four fingers may comprise a vertical part and a horizontal part, wherein a spring is fitted within each of the parts. The finger-engaging member may comprise a stopper component, which disables pulling of the finger-engaging member towards the user's palm until the finger-engaging member is pressed down which releases the stopper.

In some embodiments, the device may provide an indication to the user that the finger has successfully performed the full motion, for example by playing a sound, providing a haptic indication, lighting a light source such as a Light Emitting Diode (LED), or the like.

Another technical solution of the disclosure comprises a sensor system associated with each finger-engaging member. The sensor system may sense the position of the finger-engaging member and hence indicate whether the user has applied sufficient force for the first part and for the second part of the gesture. The sensors' output may be provided to a controller which may transmit the outputs to a computing device, such as a computer, a mobile phone, a tablet or the like.

In some exemplary embodiments, the sensor system may comprise a magnet positioned on a moving part, such as an end of the horizontal spring of the finger-engaging member, and a magnetic sensor embedded within the body, for example at or near the other end of the spring. The magnetic sensor may be a Hall effect sensor which outputs voltage as a function of the magnetic field, which is affected by the distance between the magnet and the sensor, wherein the distance changes as the user activates the finger-engaging member.

The sensing system may be battery-operated using rechargeable or other batteries.

Another technical solution of the disclosure comprises an application executed by a computing platform, the computing platform being in operative communication with the controller.

In some embodiments, the application may receive indications of the state of each of the finger-engaging members from the controller, and reflect the situation to the user. For example, the application may display to the user how much the user pressed each of the finger-engaging members, and whether any of them was fully pressed in the vertical direction and in the horizontal direction. The information may further comprise additional parameters, such as response time, finger-moving speed or the like.

The information may be displayed in real-time or near-real time, for example as a series of numbers, using color coding, as a dynamically changing progress graph or histogram, or the like. The information may further comprise comparison to other users or to a benchmark, or the like.

The information may be further transmitted to a predefined person, such as a teacher, a tutor, a caregiver such as a physiotherapist or a physician, or the like.

The information may also be collected over time, such that the user or another person can assess the diligence and progress of the user.

In further embodiments, the application, or a different application, may present to the user a mental challenge, wherein the user needs to activate specific one or more of the finger-engaging members in response to the challenge. The application may then assess the user's response for complying with the challenge as well as activating the required force.

For example, the application may display a multi-choice question, such as "17*2=" with four options:

20: press index finger.
27: press middle finger.
34: press ring finger.
40: press pinky.

It is appreciated that selecting one or more of the options may require pressing multiple fingers, for example "for selecting 34 press index and middle fingers", or that two or more options may be correct, for example a challenge requiring to identify the numbers that divide by 3 out of four given numbers. The application may then check one or more of the following criteria:

1. Whether the correct finger-engaging member or members have been pressed;
2. Whether the other finger-engaging member(s) have not been pressed;
3. For each of the correct finger-engaging member, whether each such member has been fully pressed both in the vertical and in the horizontal dimensions;
4. Whether the finger motion complies with other requirements, such as response time, speed or the like.

It is appreciated that the device may be manufactured in a number of sizes, for example a size suitable for young children, a size suitable for older children, a size suitable for adults with ordinary hand size, and a size suitable for big-handed adults. For example, the device may be made in sizes from about 5 cm in width, 5 cm in length and 3 cm in height, to about 15 cm in width, 15 cm in length and 7 cm in height. It is further appreciated that the device may be manufactured with springs of different characteristics, for example stronger and weaker springs, thus also making the device suitable for various uses and users.

The user's finger may have to be pressed along a vertical distance of 2-6 cm, and a similar horizontal distance. Thus, the springs therein may have a length of about 1.5-5.5 cm, a diameter smaller than a finger, e.g. between 0.5 cm and 2 cm, and a spring constant of about 200-800 $N/m^2$. However, it is noted that these numbers are exemplary only, and may change in accordance with the used materials, the device size, the amount of force a user needs to exert, and the like.

It is also appreciated that the device may also be realized in further embodiments. For example, instead of the finger-engaging member enforcing a piecewise-linear path of the finger, other embodiments may require the user to make a gesture comprising a single path where the user's finger is bent such that the path is curved.

One technical effect of the disclosure relates to a device for exercising a user's fingers, in particular for a gripping two-dimensional motion, or a two stage motion comprising a vertical motion followed by a horizontal motion which is important for many applications.

Another technical effect of the disclosure relates to the device being portable and small, of about the size of a hand of a user, and may be produced at an affordable price, which makes it particularly suitable for home use and training, such that a user can practice on his free time and is not limited to clinic visits.

Yet another technical effect of the disclosure relates to the device being adapted to measure, monitor, track and communicate to the user and/or to another person the performance of the user, including for example when and for how long the user practiced, how well the user did, the progress of the user, or the like.

Yet another technical effect of the disclosure relates to the device being adapted to be operated in combination with an application providing a mental challenge, to make practice more interesting and appealing for a user, thus avoiding boredom which may lead to early desertion of the device and the exercising. The mental challenge may be dynamic, for example adapted to the user's age or level, and advancement.

In some embodiments, to enable adjustment of the device to a specific user, or to adjust the device as the user's needs change, the springs within the device may be adjusted such that different amounts of forces are required to complete the motion. For example, the springs may be hooked at different points along their recesses. Such versatile device may also be used by a plurality of users, such as multiple family members.

Figure 1B:
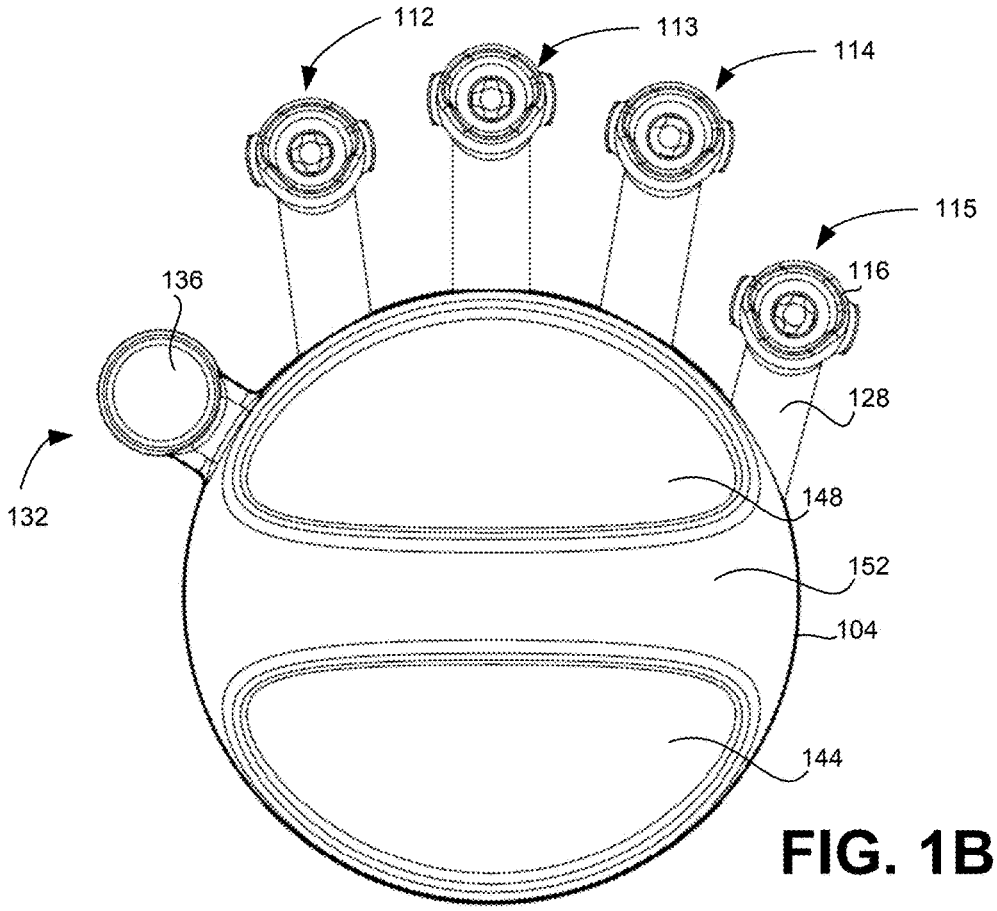
Figure 1C:
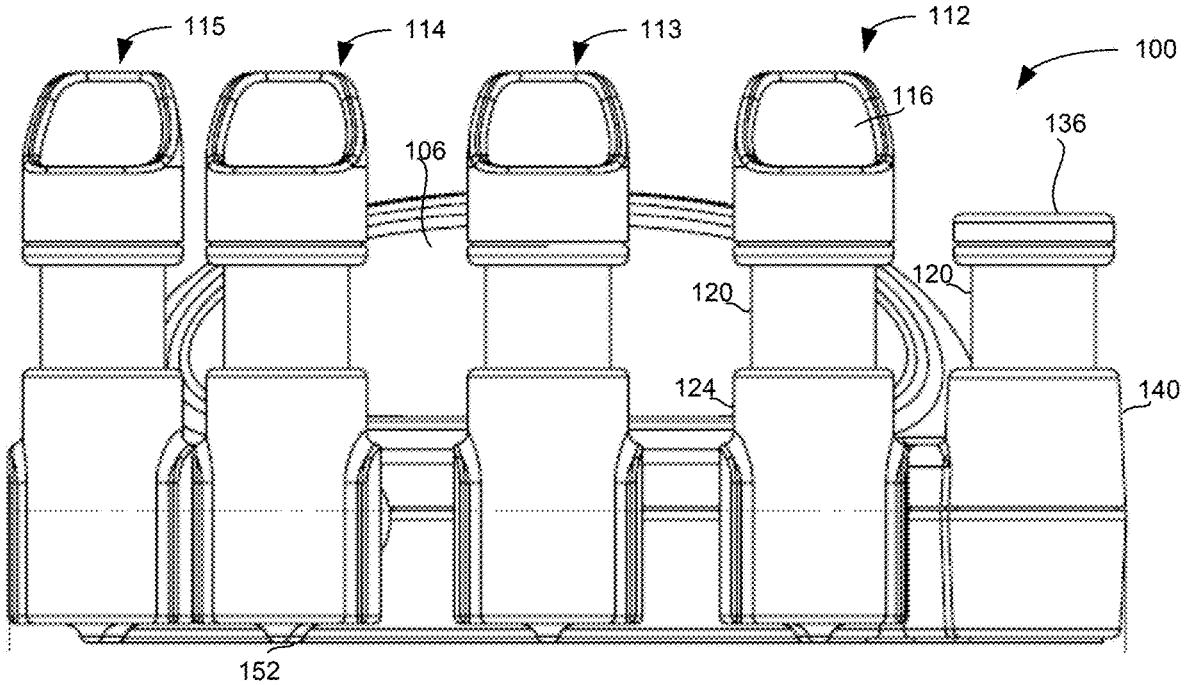

Referring now to FIGS. 1A, 1B and 1C, showing an isometric view, top view and front view of a device 100 for exercising a user's fingers, in accordance with some exemplary embodiments of the disclosure.

It is appreciated that device 100 is exemplary only, and similar devices can be designed in a plurality of manners without deviating from the principles of the shown device.

Finger exercising device 100 may comprise a body 104, four (4) finger-engaging members 112, 113, 114 and 115 and a thumb-engaging member 132.

Body 104 may comprise a top shell 106 and a bottom shell 108. Body 104 may also comprise a bottom soft cover (not shown) adapted to increase the friction between the bottom side of bottom shell 108 and a plane such as a table the device is placed on.

Top shell 106 may comprise a proximal lower area 144 and a distal lower area 148, and an elevated area 152 therebetween. The user may rest the hand on top shell 106, such that the wrist and knuckles rest on lower areas 144 and 148, respectively, and the palm rests on elevated area 152. The user's index finger, middle finger, ring finger and pinky may be placed on finger-engaging members 112, 113, 114 and 115, respectively, and the user's thumb may rest on thumb-engaging member 132.

Thumb-engaging member 132 may comprise a top cover 136, an insert 120 and a base 140.

The user may place the thumb on top cover 136 and press down the thumb, such that insert 120 is pushed into base 140.

Each of the other finger-engaging members 112, 113, 114 or 115, for example finger-engaging member 112, may comprise a finger cup 116, an insert 120 and a slider, comprising a slider body 124 and a slider neck 128.

Finger cup 116 may be designed such that its rim that is closer to the palm of the user is higher than the rim that is farther from the palm of the user, such that the user's finger will not slide forward when the user exerts force on the finger-engaging member.

The user may place one or more fingers within the corresponding finger cups, for example the index finger may be placed within finger cup 116. The user may then push down one or more finger cups 116 which in turn pushes down insert 120. Once insert 120 is inserted to the maximum into slider body 124, the user may complete a gripping motion and pull slider body 124 towards body 104, such that slider neck 128 is inserted into body 104. It is noted that pulling slider body 124 towards body 104 is enabled only after insert 120 is fully inserted into slider body 124 by the vertical motion. This gesture, which is realized by a downward motion followed by a forward motion and may be referred to as a gripping motion is important for certain applications, and in particular for music players or music students, for example piano players.

Figure 2A:
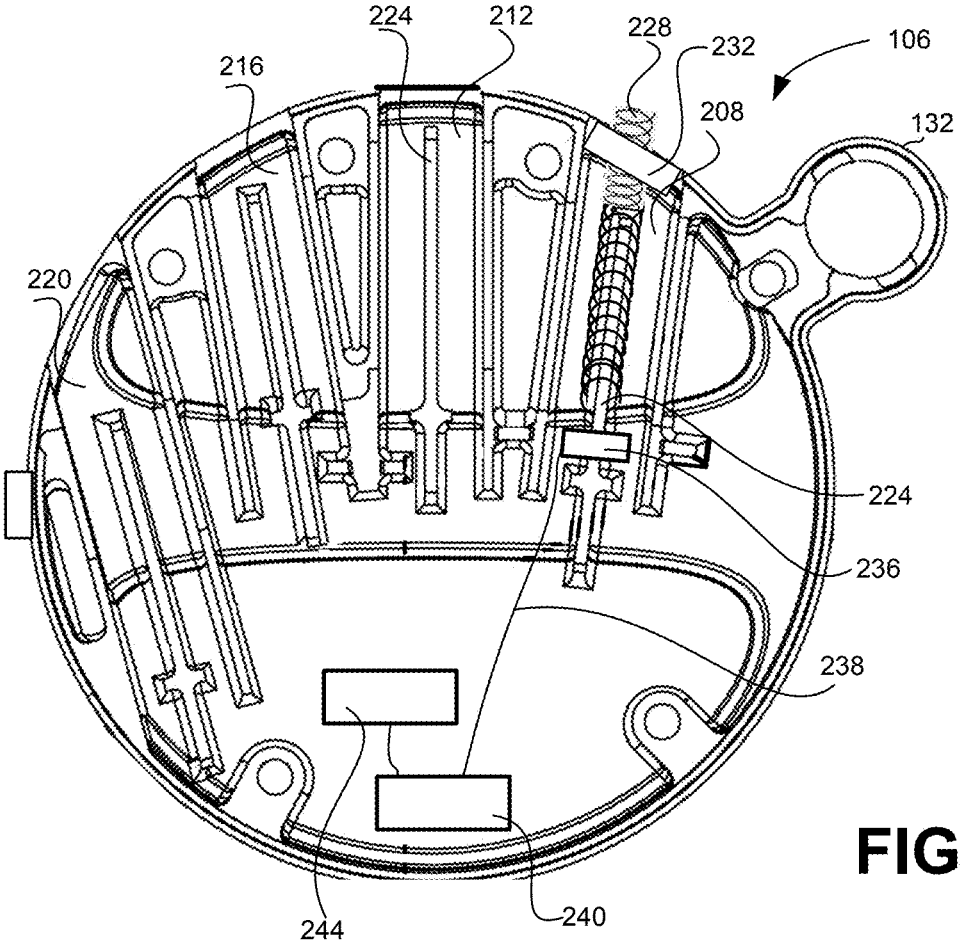
FIGS. 2A and 2B show a bottom view and a top view, respectively, of a top shell of the device of FIGS. 1A-1C, in accordance with some exemplary embodiments of the disclosure.
Figure 2B:
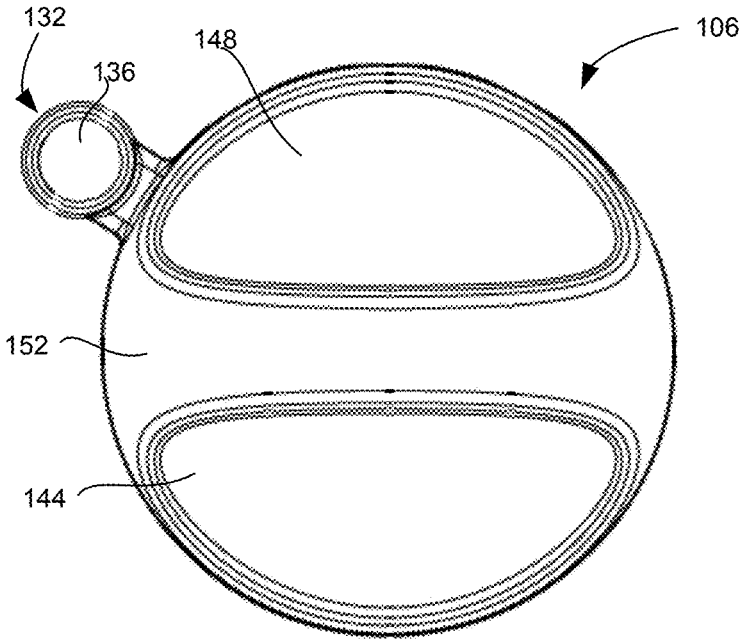

Referring now to FIG. 2A, showing a bottom view of top shell 106, and to FIG. 2B showing a top view of top shell 106, in accordance with some exemplary embodiments of the disclosure.

The bottom plane of top shell 106 may comprise up to four (4) recesses, each adapted to receive a part of the slider neck 128 of the corresponding finger-engaging member. Thus, each of recesses 208, 212, 216 and 220 may be adapted to receive parts of slider neck 128 of finger-engaging members 112, 113, 114 and 115, respectively, after the user pushed down inserts 120 of said finger-engaging members and then pulled the corresponding slider towards the user's palm.

Each such recess may comprise a rod 224 extending from elevated area 152 towards openings in the distal part of top shell 106. A spring 228 may be placed around each rod 224, to provide resistance to the gripping motion of the corresponding finger.

Figure 3A:
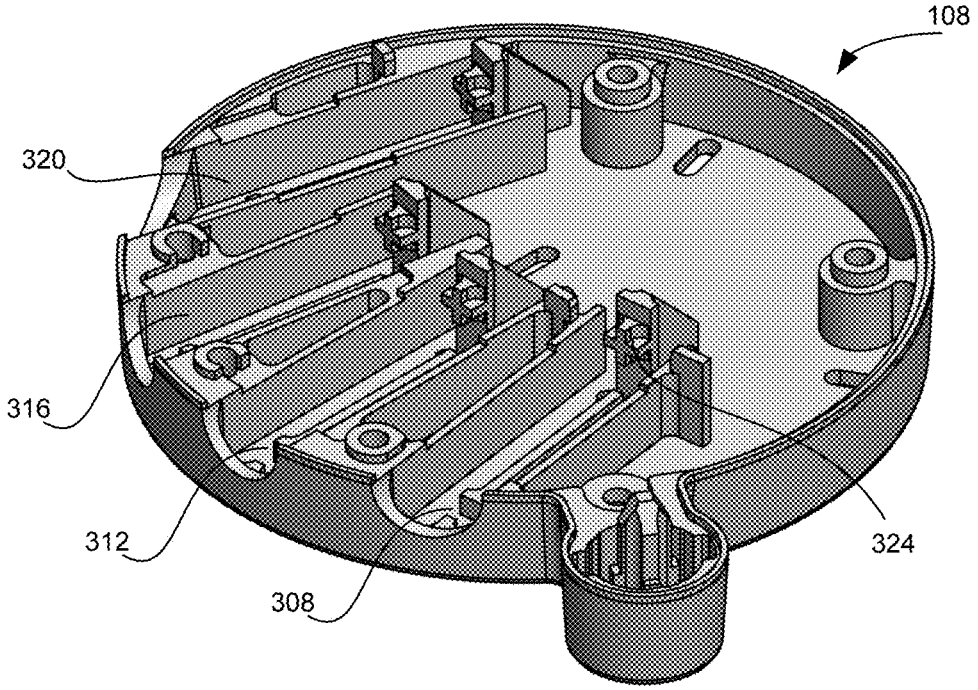
FIGS. 3A and 3B show a top view and a bottom view, respectively, of a bottom shell of the device of FIGS. 1A-1C, in accordance with some exemplary embodiments of the disclosure.
Figure 3B:
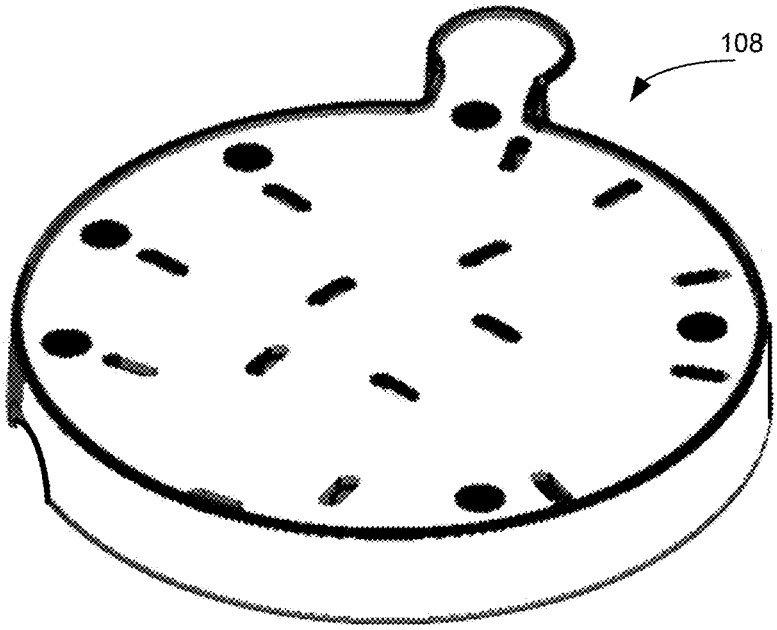

Referring now also to FIG. 3A, showing a top view of bottom shell 108, and to FIG. 3B, showing a bottom view of bottom shell 108, in accordance with some exemplary embodiments of the disclosure.

Bottom shell 108 may comprise four recesses 308, 312, 316, and 320 which complement recesses 208, 212, 216, and 220 of top shell 106 when the device is assembled to create substantially round openings in body 104. Each such recess may comprise an extrusion at its proximal end, for example a cross-shaped extrusion 324, to which the corresponding spring, such as spring 228 may be coupled, for example threaded into an elongated hole of extrusion 324.

Figure 3C:
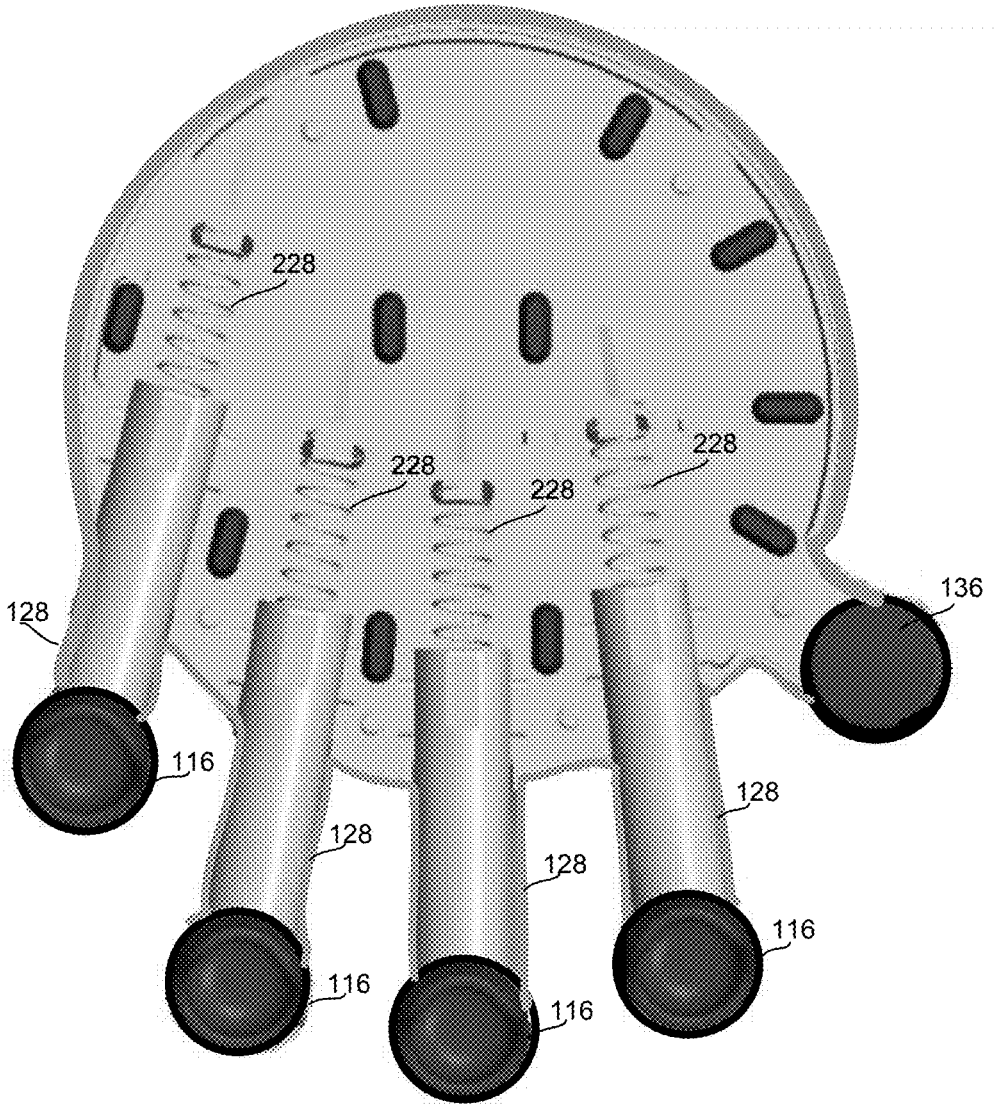
FIG. 3C shows a top view of the bottom shell with the springs, in accordance with some exemplary embodiments of the disclosure.

FIG. 3C shows a top view of bottom shell 108, button 136 of the finger-engaging member for the thumb, and finger cup 116 and slider neck 128 of the finger-engaging members for the other fingers. FIG. 3C further shows springs 228, where the sliders are at a neutral position and are not pulled towards the user's palm.

Figure 4:
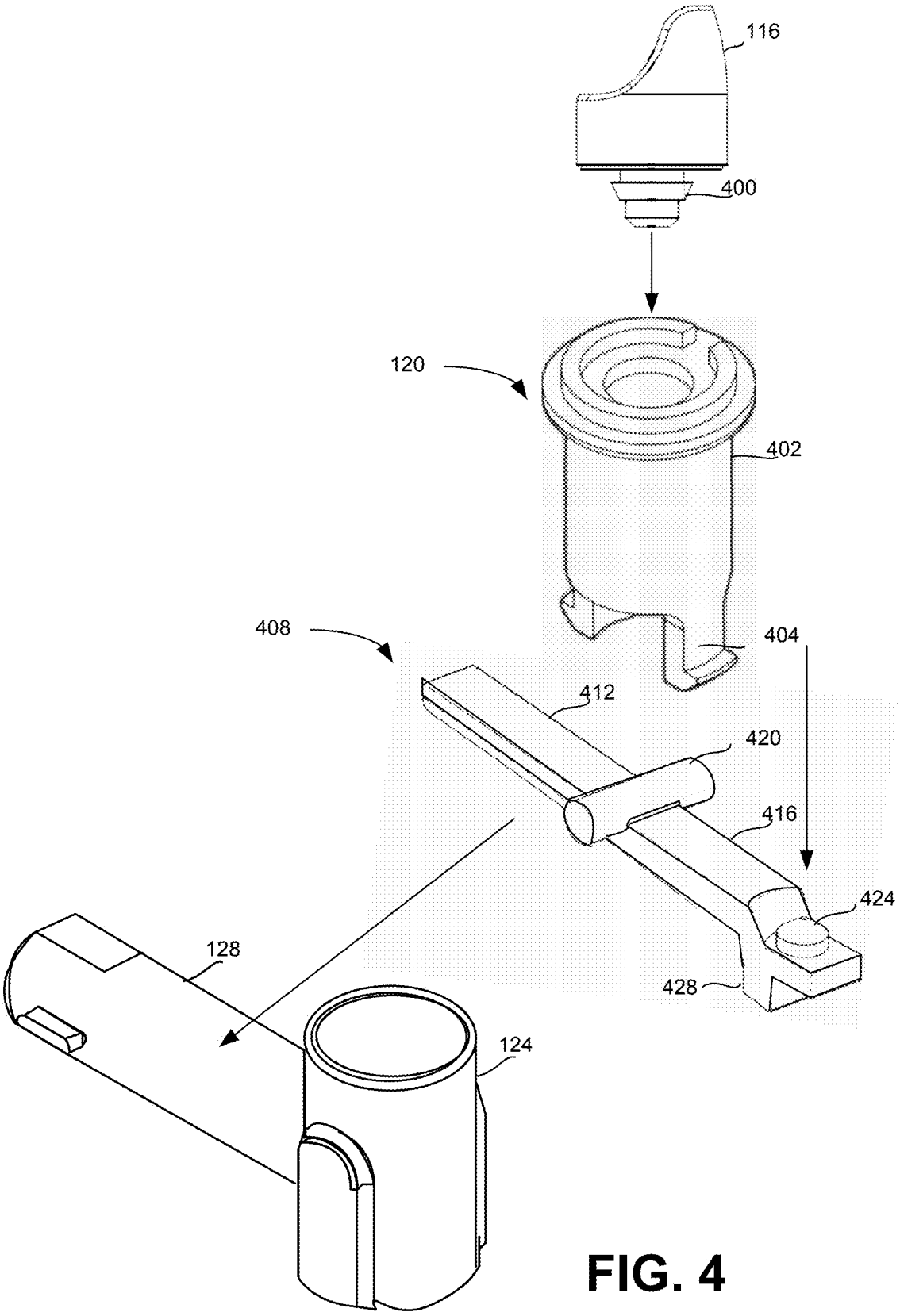
FIG. 4 shows a breakdown of a finger-engaging member, in accordance with some exemplary embodiments of the disclosure.

Referring now also to FIG. 4, showing a breakdown of a finger-engaging member, in accordance with some exemplary embodiments of the disclosure.

The finger-engaging member, such as finger-engaging member 112, comprises finger cup 116. The bottom part of finger cup 116, comprising for example some adjustment 400, may be firmly inserted into insert 120. Part or all of cylindrical part 402 of insert 120 may be pushed into slider neck 124 by the user's finger, which has to overcome the resistance caused by a substantially vertical spring put inside insert 120. It is noted that insert 120 has at its bottom part one or more legs or protrusions 404.

The finger-engaging member may further comprise a sopper 408. Stopper 408 may have two elongated portions 412 and 416, and a cylindrical portion 420 therebetween, having its longitudinal axis perpendicular to the long axis of portions 412 and 416. Stopper 408 may also have a protrusion 428 at or near its proximal end when installed within a slider of a finger-engaging member.

Figure 5:
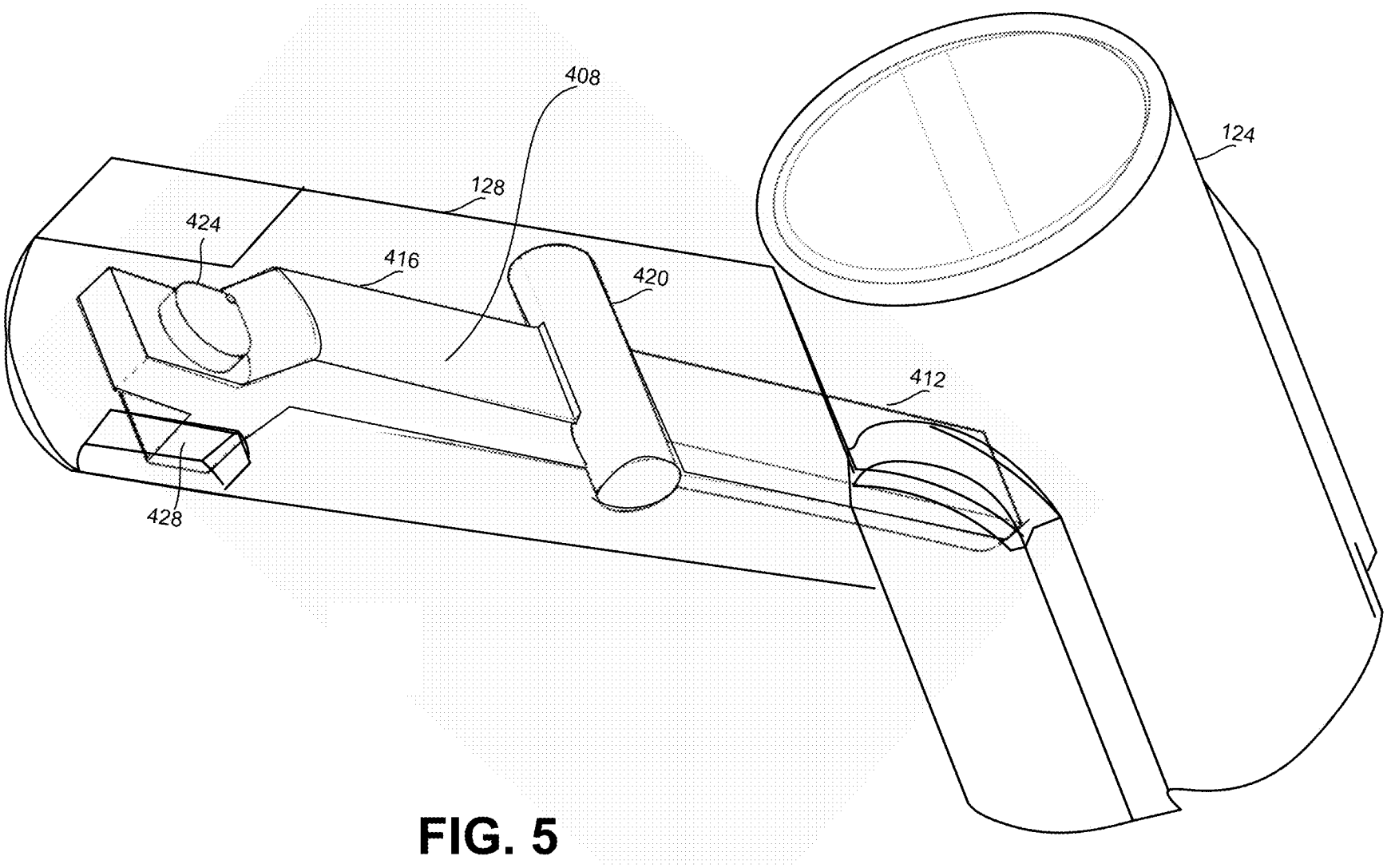
FIG. 5 is an illustration of a slider with a stopper inside, in accordance with some exemplary embodiments of the disclosure.

Referring now also to FIG. 5, showing a slider with a stopper inside, in accordance with some exemplary embodiments of the disclosure.

Thus, FIG. 5 shows slider neck 128, and elongated stopper 408 which is substantially horizontal, such that its distal end is within slider body 124, and the rest within slider neck 128.

When insert 120 is not pushed all the way down by the user's finger, protrusion 428 of stopper 408 is sunk in a corresponding recess of slider neck 128, thereby preventing slider neck 128 from being pushed into body 104. When the user's finger pushes down finger cup 116 it in turn pushes insert 120, such that legs 404 push down the end of portion 412 of stopper 408. Stopper 408 then rolls around cylindrical portion 420, thus lifting up portion 416 such that protrusion 428 is out of the recess of slider neck 128, such that when the user pulls the finger forward, slider neck 128 (as well as slider body 124) can advance towards the user's palm.

The combination of the downward motion, which is required to precede the inward motion can be regarded as a gripping motion by the finger, which is of particular importance.

In some embodiments, stopper 408 may comprise a protrusion 424 on the opposite side of protrusion 428. A spring may be coupled to protrusion 424, wherein the spring is in its neutral state when portion 412*f* stopper 408 is not pushed down. When portion 412 of stopper 408 is pushed down, the spring may be compressed. When compressing portion 412 stops, the spring may assume its neutral state and urge protrusion 428 down into the corresponding recess, such that slider neck 128 cannot be pulled towards the user's palm.

It is appreciated that parts of the device, and in particular insert 120, stopper 408, top shell 106, bottom shell 108, the slider comprising slider body 124 and slider neck 128 may be made of a material that offers stiffness, low friction, and dimensional stability. In a non-limiting example, Polyoxymethylene (POM) may be used, which is also known as acetal, polyacetal, or polyformaldehyde. Short-chained POM (having chain length of between 8 and 100 repeating units) also known as paraformaldehyde (PFA) may also be used.

It is also appreciated that other parts of the device, and in particular finger cup 116, thumb button 136 and the bottom soft cover, may be made of materials that are elastic and resistant to oil, grease, and abrasions, such as but not limited to polyurethane plastics, for example Thermoplastic polyurethane (TPU), gum, Latex, or the like.

Referring now back to FIG. 2. The device may further comprise for one or more fingers, a sensing mechanism for assessing the position of the slider, and hence for assessing to what degree the user has successfully completed the gripping gesture.

Thus, in some exemplary embodiments, there may be coupled a magnet 232 to the distal end of each spring 228. Magnet 232 may have a width, for example, of between 3 mm and 10 mm.

A magnetic sensor, such as a Hall effect sensor 236 which measures a magnetic field may be placed at or near the proximal end of the spring. As the user's finger when making a forward motion compresses the spring towards the palm, the magnet comes closer to the sensor, and the voltage output by the sensor increases.

The voltage output by each sensor for the corresponding finger may be provided, for example through wire 238, to a controller or microcontroller 240.

Microcontroller 240 may execute a program which samples the voltage produced by the sensors. When one or more of the voltages exceeds a threshold, microcontroller 240 may transmit a signal to an associated computing platform, such as a mobile phone, a tablet computer, a laptop computer, a desktop computer or the like. The signal may be transmitted by a communication module, whether embedded within the controller or separate therefrom. The signal may comprise the measured voltage or a processing result thereof, and/or an indication of the associated sensor, which indicates the associated finger. Transmission may be performed using any known channel and protocol, such as wired, Bluetooth®, Wi-Fi, cellular, or the like.

Microcontroller 240 may also provide the power to sensors 236.

Microcontroller 240 may be powered, for example, by a rechargeable battery, for example a rechargeable Lithium Polymer battery. The battery can be charged via a USB-C or any other suitable connecter. The battery may be connected via a sliding power switch (not shown), allowing the device to be turned on or off.

Figure 6:
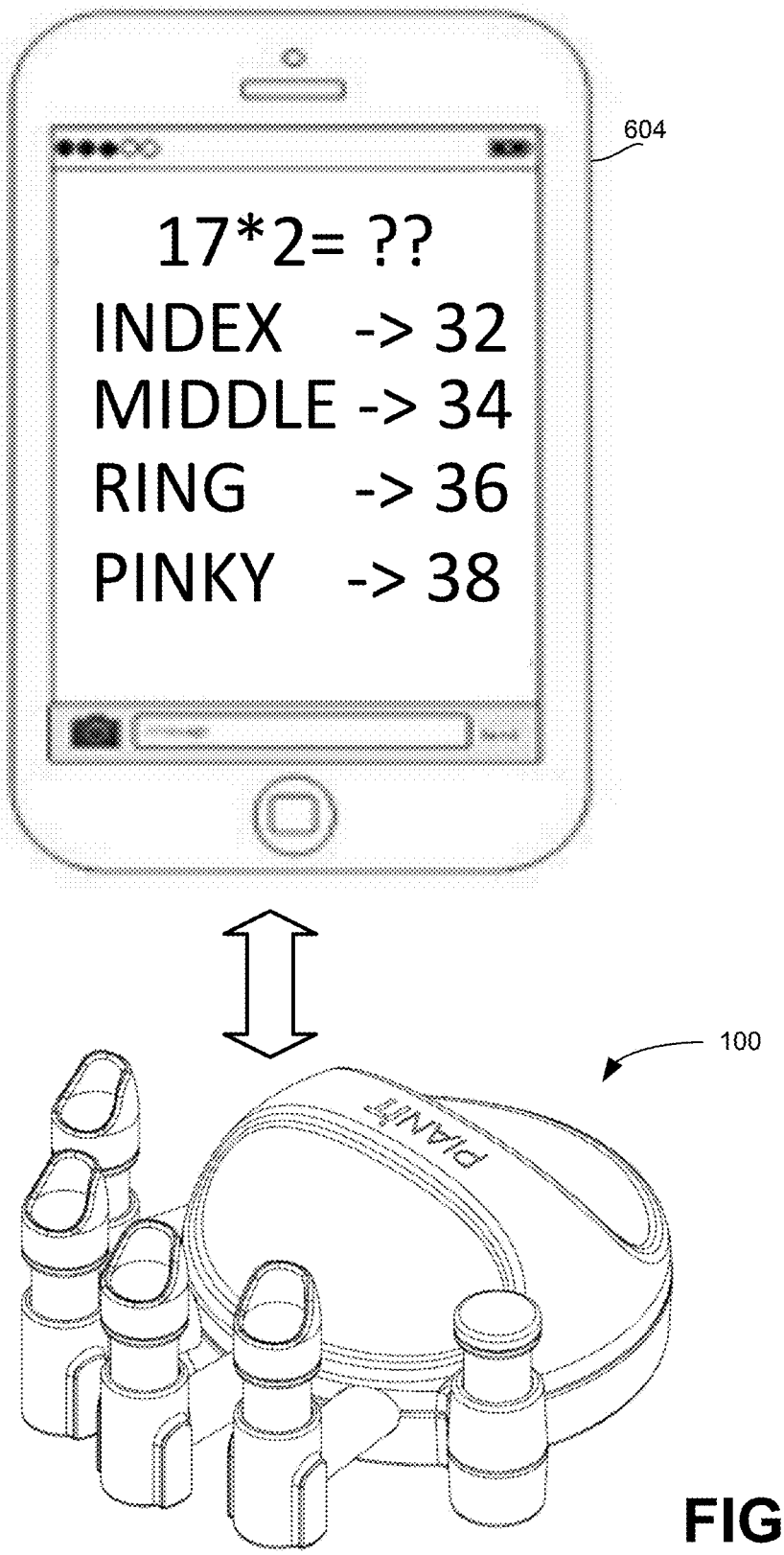
FIG. 6 is a schematic illustration of a system for exercising a user's fingers, in accordance with some exemplary embodiments of the disclosure.
Figure 7:
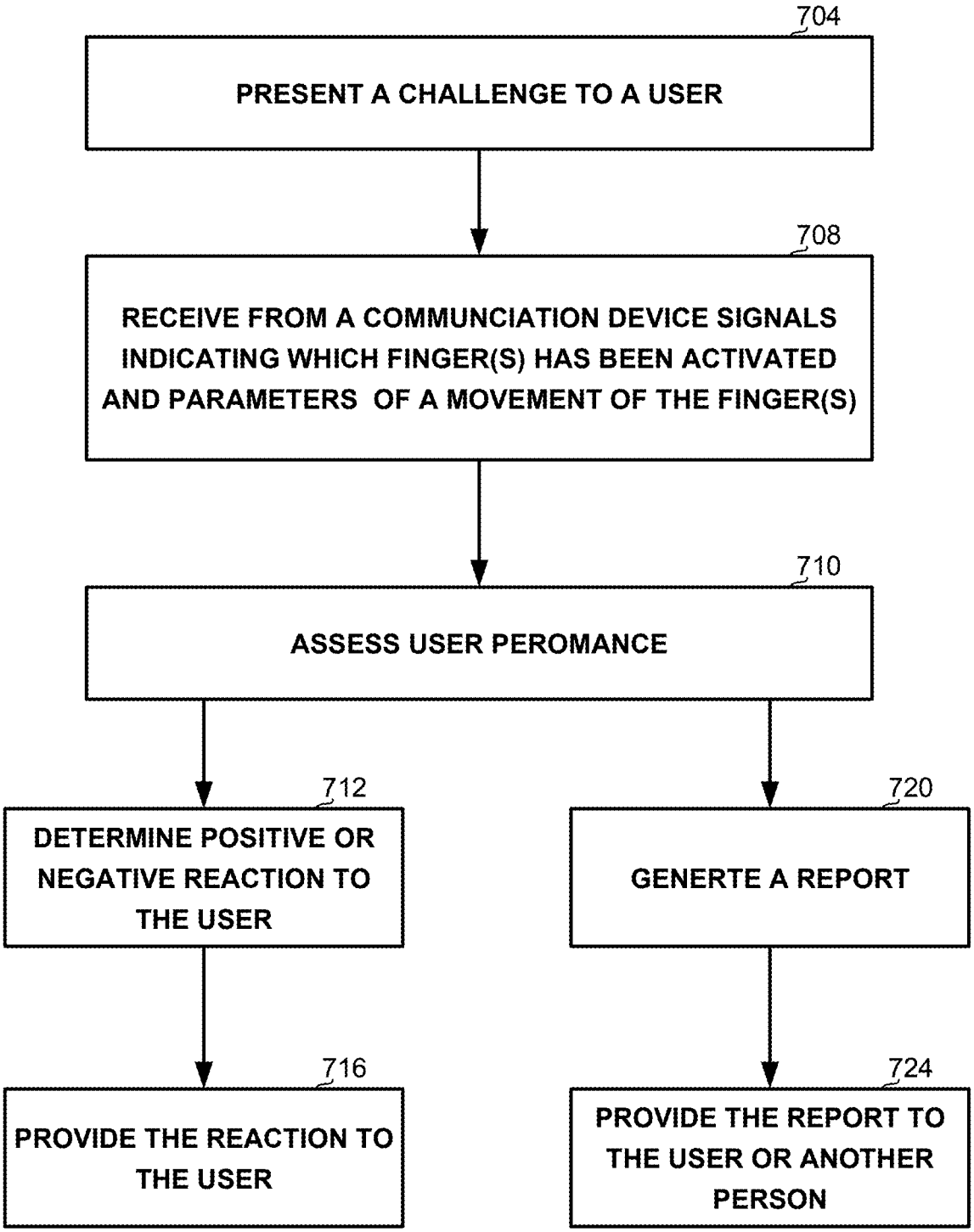
FIG. 7 is a flowchart of a method for exercising a user's fingers, in accordance with some exemplary embodiments of the disclosure.

Referring now to FIG. 6, showing a system for exercising a user's fingers, and to FIG. 7, showing a flowchart of a method exercising a user's fingers, in accordance with some exemplary embodiments of the disclosure.

The system may comprise a computing device 604, such as a mobile phone, a tablet, a desktop or laptop computer, or the like.

Computing device 604 may comprise a processing unit, such as a System on Chip (Soc), one or more processors, one or more Central Processing Units (CPUs), microprocessors, electronic circuits, Integrated Circuits (IC), graphic processing unit (GPU), or the like. The processor may be configured to provide the required functionality, for example by loading to memory and executing modules detailed below.

Computing device 604 may comprise a storage medium, which may be implemented as a memory chip, a hard disk drive, a Flash disk, a Random Access Memory (RAM), Read Only Memory (ROM), an MCU memory, or the like. The storage device may comprise one or more storage units which may be operatively connected, and may also be operatively connected to further storage units located on other computing devices, whether co-located with the computing platform, or in operative communication therewith, such as remote, cloud-based, or the like.

The storage medium may retain an application in the form of an executable program, a web application, or the like.

Computing device 604 may comprise a communication device, for communicating with device 100 and optionally other computing platforms, for example a communication device of a teacher or caregiver of the user. The communication device may be adapted to communicate via any one or more channels or protocols, such as but not limited to BlueTooth®, Wi-Fi, cellular, Ethernet, or others.

The application may comprise one or more modules, libraries, or other executable units, adapted to receive settings from a user, select a question, display the question, receive signals from the device, analyze the signals to determine the user's current performance and/or long-time performance, display results to a user, and/or generate and transmit reports.

Computing device 604 may comprise an Input Output (I/O) device, such as a display, a pointing device, a keyboard, a touch screen, a microphone, a speaker, or the like. The I/O device can be utilized to receive input and provide output to and from a user. For example, the I/O device can present mental challenges to a user, display the user's performance, receive instructions or settings from a user such as difficulty degree of the displayed questions, or the like. The I/O device may be further used for displaying a difficulty degree or other settings of the required performance, such as number or combination of fingers to be activated at the same time, questions display rate, expected response time, expected gesture speed, or the like.

At step 704, computing device 604, once a corresponding application, web application or another executable is activated, may present a mental challenge to the user, such as a multi-choice question, and instructions of which finger(s) is/are to be activated for each answer. An example to a question for which there are multiple answer may be "which are the odd numbers", "mark words spelled correctly", "which of the following has been a US president", or the like. The challenge may be displayed visually, read orally, or the like.

The question or challenge may be selected from a pre-stored collection of questions or challenges, catalogued by level. In further embodiments, computing device 604 may be connected to the Internet and to changing question collections. In yet further embodiments, computing device 604 may comprise or otherwise operatively connect to an artificial intelligence (AI) engine for online generation of questions.

The user may then have to select one or more options by activating the indicated fingers, within a predefined and optionally configurable period of time.

At step 708, computing device 604 may receive from the device signals indicating which finger or fingers have been activated, and parameters of the movement of the finger(s), such as pressing speed, response time, or the like.

At step 710, computing device 604 may, according to the signals received from the device, determine whether the user's answer is correct or not, and whether the user has performed the correct gesture to a satisfactory degree.

Computing device 604 may assess whether the signals indicate that an answer has been received if any of the signals exceeds a certain threshold, for example indicates that a distance between the ends of the corresponding spring is below a maximal threshold. Computing device 604 may assess in accordance with the activated finger whether the answer is correct, and may also assess the performance according to the signal value. Computing device 604 may also take into account the user's response time, speed of pressing any of the springs, or the like.

At step 712, computing device 604 may determine a positive or negative reaction for the user. The reaction may be a visual or vocal indication to the user's success or failure, with or without an explanation, such as "correct answer but insufficient pressing", "incorrect answer but nice press". The reaction may include a qualitative or numeric assessment of the gesture performance, or the like. The reaction may also comprise a reward, such as positive or negative points, a voucher, or the like.

At step 716 computing device 604 may provide the reaction to the user, for example display text or images over a display device, play an audio, or the like.

A session may continue for a predetermined and optionally configurable number of questions, optionally with varying degree of difficulty or rate. Additionally or alternatively, the session may continue until the user stops, or any other stopping criteria is met.

At step 720 computing device 604 may generate a report, which may include further information regarding the user's performance, such as the number of correct/incorrect answers, the user's pressing performance, the length of the session, or the like. The report may also comprise the user's performance over time, such as the performance relative to previous sessions or relative to some benchmark, how often and for how long the user practiced, or the like.

At step 724, the report may be sent or otherwise provided to the user, and/or to another person, such as a physician, a physiotherapist, a teacher, or the like.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the description and claims of the application, each of the words "comprise" "include" and "have", and forms thereof, are not necessarily limited to members in a list with which the words may be associated. In addition, where there are inconsistencies between this application and any document incorporated by reference, it is hereby intended that the present application controls.

What is claimed is:

1. A finger training device comprising:

a body; and a plurality of finger-engaging members connected to the body, wherein at least one of the plurality of finger-engaging members is pressable against a resisting force along a path comprising a curved or piecewise linear path, wherein the curved or piecewise linear path comprises a vertical portion and a horizontal portion, and wherein at least one of the plurality of finger-engaging members comprises:

a slider comprising a first part and a second part;

a finger cup configured for receiving at least a distal part of a finger of a user; and an insert configured to be pushed down by the finger cup when the finger cup is pushed down by the finger, wherein the first part of the slider is configured to receive a portion of the insert, the portion of the insert configured to vary in accordance with a first press applied to the insert by the finger when inserted into the finger cup, and wherein the body is configured to receive a portion of the second part of the slider, the second portion varying in accordance with a second press applied to the slider by the insert.

2. The finger training device of claim 1, further comprising:

a sensor system comprising:

at least one sensor coupled to each of at least one finger-engaging member of the plurality of finger-engaging members, for sensing movement of the at least one finger-engaging member;

a controller for communicating with the at least one sensor; and the communication device for receiving indications to the movement from the controller and transmitting the indications to a computerized platform.

3. The finger training device of claim 2, wherein the at least one sensor comprises:

a magnet located at or near a first end of the second spring; and a magnetic sensor located at or near a second end of the second spring, for outputting an indication of a distance of the magnetic sensor from the magnet.

4. The finger training device of claim 3, wherein the magnetic sensor is a Hall effect sensor.

5. The finger training device of claim 2, wherein the computerized platform is configured to execute an application, the application configured to:

present to a user a challenge, wherein an expected reaction to the challenge comprises activating at least one of the plurality of finger-engaging members;

receive from the communication device information comprising an indication to which finger-engaging member from the plurality of finger-engaging members has been activated and parameters of a movement of the finger;

determine based on the information a positive or negative reward to be provided to the user; and provide the positive or negative reward to the user or to another person.

6. The finger training device of claim 5, wherein the application is further configured to:

generate a report; and provide the report to the user or to another person.

7. The finger training device of claim 1, wherein the first press is applied by the user pressing down a finger inserted into the finger cup, and the second press is applied by the user pulling the fingertip towards the palm of the user.

8. The finger training device of claim 7, wherein in order for the slider to be movable into the body, the finger cup has to be lowered first.

9. The finger training device of claim 1, wherein traversal of the horizontal portion follows traversal of the vertical portion.

10. The finger training device of claim 1, wherein the first part of the slider is vertical and the second part of the slider is horizontal, when the finger training device is in use.

11. The finger training device of claim 1, wherein the first part of the slider comprises a first spring and the second part of the slider comprises a second spring, and wherein the first press is applied against the first spring, and the second press is applied against the second spring.

12. The finger training device of claim 1, wherein a first part of the finger cup that is closer to a palm of the user has a higher rim than a second part of the finger cup that is farther from the palm of the user.

13. A computer program product comprising non-transitory computer program instructions configured, when executed by a processor, to cause the processor to perform:

presenting to a user a mental challenge, wherein an expected reaction to the mental challenge comprises activating at least one of a plurality of finger-engaging members of a finger training device comprising the plurality of finger-engaging members connected to a body, the finger training device operatively connected to a computing device executing the computer program instructions;

receiving from a communication device information comprising an indication to which finger-engaging member from the plurality of finger-engaging members has been activated and parameters of a movement of a finger; and determining based on the information a positive or negative reward to be provided to the user; and providing the positive or negative reward to the user, wherein within the finger training device, at least one of the plurality of finger-engaging members is pressable against with resisting force along a path comprising a curved or piecewise linear path, wherein the curved or piecewise linear path comprises a vertical portion and a horizontal portion; and wherein at least one of the finger-engaging members comprises:

a slider comprising a first part and a second part;

a finger cup configured for receiving at least a distal part of a finger of a user; and an insert configured to receive a first portion of the finger cup, wherein the first part of the slider is configured to receive a portion of the insert, the portion of the insert configured to vary in accordance with a first press applied to the insert by the finger when inserted into the finger cup, and wherein the body is configured to receive a portion of the second part of the slider, the second portion varying in accordance with a second press applied to the slider by the insert.

14. The computer program product of claim 13, wherein the computer program instructions are further configured to:

generate a report; and provide the report to the user or to another person.

15. A method for training fingers, comprising:

presenting to a user a mental challenge, wherein an expected reaction to the mental challenge comprises activating at least one of a plurality of finger-engaging members of a finger training device comprising the plurality of finger-engaging members connected to a body, the finger training device operatively connected to a computing device executing the computer program instructions;

receiving from a communication device information comprising an indication to which finger-engaging member from the plurality of finger-engaging members has been activated and parameters of a movement of a finger; and determining based on the information a positive or negative reward to be provided to the user; and providing the positive or negative reward to the user;

generating a report; and providing the report to the user or to another person, wherein within the finger training device, at least one of the plurality of finger-engaging members is pressable against with resisting force along a path comprising a curved or piecewise linear path, wherein the curved or piecewise linear path comprises a vertical portion and a horizontal portion; and wherein at least one of the finger-engaging members comprises:

a slider comprising a first part and a second part;

a finger cup configured for receiving at least a distal part of a finger of a user; and an insert configured to receive a first portion of the finger cup, wherein the first part of the slider is configured to receive a portion of the insert, the portion of the insert configured to vary in accordance with a first press applied to the insert by the finger when inserted into the finger cup, and wherein the body is configured to receive a portion of the second part of the slider, the second portion varying in accordance with a second press applied to the slider by the insert.

16. The method of claim 15, further comprising:

generate a report; and provide the report to the user or to another person.

* * * * *